US011821343B2

(12) United States Patent
Riedl et al.

(10) Patent No.: US 11,821,343 B2
(45) Date of Patent: Nov. 21, 2023

(54) INTERNAL COMBUSTION ENGINE AND METHOD FOR OPERATING AN ELECTROMECHANICAL CAMSHAFT ADJUSTER

(71) Applicant: Schaeffler Technologies AG & Co. KG, Herzogenaurach (DE)

(72) Inventors: Tobias Riedl, Aurachtal (DE); Florian Holler, Falkendorf (DE); Christian Karbacher, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/625,834

(22) PCT Filed: Jun. 18, 2020

(86) PCT No.: PCT/DE2020/100519

§ 371 (c)(1),
(2) Date: Jan. 10, 2022

(87) PCT Pub. No.: WO2021/004574

PCT Pub. Date: Jan. 14, 2021

(65) Prior Publication Data

US 2022/0259991 A1 Aug. 18, 2022

(30) Foreign Application Priority Data

Jul. 10, 2019 (DE) ..... 10 2019 118 689.7

(51) Int. Cl.
*F01L 1/352* (2006.01)
*F01L 13/00* (2006.01)

(52) U.S. Cl.
CPC ..... *F01L 1/352* (2013.01); *F01L 2001/3521* (2013.01); *F01L 2013/103* (2013.01);
(Continued)

(58) Field of Classification Search
CPC ..... F01L 1/352; F01L 2001/3521; F01L 2013/103; F01L 2013/111;
(Continued)

(56) References Cited

U.S. PATENT DOCUMENTS 4,481,912 A * 11/1984 Stwiorok ..... F02D 35/00 123/90.15
2005/0183681 A1 8/2005 Axmacher et al.
(Continued)

FOREIGN PATENT DOCUMENTS

CN 101035967 A 9/2007
CN 101052785 A 10/2007
(Continued)

OTHER PUBLICATIONS

See Corresponding Search Report for International Application PCT/DE2020/100519.

*Primary Examiner* — Jorge L Leon, Jr.
(74) *Attorney, Agent, or Firm* — Davidson, Davidson & Kappel, LLC

(57) ABSTRACT

An internal combustion engine comprises a crankshaft, at least one camshaft adjustable electromechanically by an actuating gearing, an engine control unit, and a camshaft control unit for controlling an actuating motor which operates the actuating gearing. The engine control unit is linked to a device for detecting the angular position of the crankshaft, and the camshaft control unit is linked to the engine control unit. A device for detecting a reference position of the camshaft and a device for detecting the angular position of the shaft of the actuating motor are provided as sole mechanisms for detecting the angular position of the camshaft. The camshaft control unit is designed to determine the phase angle of the camshaft in relation to the crankshaft on the basis of the information items provided by said devices
(Continued)

in combination with the detected angular position of the crankshaft and the transmission ratio of the actuating gearing.

15 Claims, 3 Drawing Sheets

(52) U.S. Cl.
CPC .... *F01L 2013/111* (2013.01); *F01L 2013/113* (2013.01); *F01L 2201/00* (2013.01); *F01L 2800/14* (2013.01); *F01L 2820/032* (2013.01); *F01L 2820/041* (2013.01); *F01L 2820/042* (2013.01)

(58) Field of Classification Search
CPC ..... F01L 2013/113; F01L 2201/00; F01L 2800/14; F01L 2820/032; F01L 2820/041; F01L 2820/042
USPC ..... 123/90.15
See application file for complete search history.

(56) References Cited

U.S. PATENT DOCUMENTS

| | | | | |
|---|---|---|---|---|
| 2005/0211208 | A1 | 9/2005 | Axmacher et al. | |
| 2005/0216177 | A1 | 9/2005 | Kassner | |
| 2005/0252469 | A1 | 11/2005 | Neubauer et al. | |
| 2006/0042074 | A1* | 3/2006 | Stork | F01L 1/344 29/622 |
| 2007/0261670 | A1 | 11/2007 | Nguyen et al. | |
| 2008/0245329 | A1 | 10/2008 | Stork et al. | |
| 2009/0183701 | A1* | 7/2009 | Nguyen | F01L 1/352 73/114.26 |
| 2011/0162445 | A1* | 7/2011 | Shimizu | F02D 13/0238 73/114.27 |
| 2015/0260140 | A1* | 9/2015 | Wang | F02D 35/028 123/445 |
| 2020/0116246 | A1 | 4/2020 | Weber et al. | |

FOREIGN PATENT DOCUMENTS

| | | | |
|---|---|---|---|
| DE | 19737999 | A1 | 3/1999 |
| DE | 10236507 | A1 | 2/2004 |
| DE | 10242659 | A1 | 3/2004 |
| DE | 10315317 | A1 | 3/2004 |
| DE | 10259133 | A1 | 7/2004 |
| DE | 102004015037 | A1 | 10/2005 |
| DE | 202005012163 | U1 | 10/2005 |
| DE | 102012219297 | A | 5/2013 |
| DE | 102004041232 | B | 7/2017 |
| DE | 102017114175 | B | 9/2018 |
| EP | 1630363 | A1 | 3/2006 |
| FR | 3014139 | A1 | 6/2015 |
| GB | 2328752 | A | 3/1999 |
| JP | 2010127192 | A | 6/2010 |
| JP | 2015004325 | A | 1/2015 |
| WO | WO2006122665 | A1 | 11/2006 |

* cited by examiner

INTERNAL COMBUSTION ENGINE AND METHOD FOR OPERATING AN ELECTROMECHANICAL CAMSHAFT ADJUSTER

CROSS-REFERENCE TO RELATED APPLICATIONS

This application is the U.S. National Phase of PCT Appln. No. PCT/DE2020/100519 filed Jun. 18, 2020, which claims priority to DE 10 2019 118 689.7 filed Jul. 10, 2019, the entire disclosures of which are incorporated by reference herein.

The present disclosure relates to a method of operating an electromechanical camshaft adjuster which comprises an actuating gearing, in particular a three-shaft gearing. Furthermore, the present disclosure relates to an internal combustion engine with an electromechanical camshaft adjuster.

BACKGROUND

Various operating methods of camshaft adjusters are described in DE 102 59 133 A1 and DE 102 42 659 A1. In particular, these publications deal with the interaction of an engine control unit with the camshaft adjuster. Wobble plate gears, which function as three-shaft gears, are used as actuating gears for the camshaft adjusters.

Another camshaft adjuster with a wobble plate gear is disclosed in DE 102 36 507 A1. In this case, mechanical means are arranged between the crankshaft of the internal combustion engine and the camshaft to be adjusted to limit the adjustment of the angle of rotation.

DE 10 2012 219 297 A1 describes a method for operating a motor vehicle which comprises an engine control unit and additionally a camshaft adjuster control unit. A CAN bus is provided for data transmission. The camshaft adjuster control unit can be started before the engine control unit start-up is completed.

WO 2006/122665 A1 describes a topology for generating an actuating signal for an electrically actuated camshaft adjuster. Here, a control unit is integrated into a regulating unit. Hall sensors are provided to detect states of the camshaft adjuster.

DE 10 2004 041 232 B4 describes a method for operating a camshaft adjuster, which may comprise an electric or a hydraulic actuating device. In any case, reference and/or base values relating to the state of the camshaft adjuster are obtained by averaging values from different points in time as part of the operating procedure.

SUMMARY

An object of the present disclosure is achieving progress in the control of electromechanical camshaft adjusters, in particular with regard to the use of resources for data processing.

This object is achieved by a method for operating an electromechanical camshaft adjuster of the present disclosure and by an internal combustion engine of the present disclosure. The embodiments and advantages of the present disclosure explained below in connection with the internal combustion engine and its components also apply analogously to the operating method and vice versa.

The internal combustion engine is designed as a reciprocating piston engine and comprises a crankshaft and at least one electromechanically adjustable camshaft in a basic structure known per se. An actuating gearing is provided for adjusting the camshaft, which is for example a three-shaft gearing, in particular a harmonic drive. In this context, reference is made to DE 10 2017 114 175 B3 as an example.

The camshaft adjuster is operated as follows:

- The angular position of the crankshaft is continuously determined, wherein an incremental detection of angular changes takes place starting from a detected angular reference position,
- the detected angular positions of the crankshaft are written into a first ring buffer, which is rewritten recurrently,
- a reference position of the camshaft is detected, in particular with the aid of a trigger disk,
- the point in time at which the reference position of the camshaft was given is assigned to an angular position of the crankshaft with the help of the data stored in the first ring buffer and related to the same point in time,
- with reference to said point in time, changes in the angular position of a rotor of an electric motor driving an adjusting shaft of the actuating gearing are detected and written into a further ring buffer, wherein the rotor is preferably connected to the adjusting shaft in a non-rotatable manner or is identical to it,
- the current angular position of the camshaft is calculated from the detected angular changes of the rotor, taking into account the transmission ratio of the actuating gearing, and assigned to a current angular position of the crankshaft,
- the difference between the two angular positions specified, i.e. the phase difference between the crankshaft and the camshaft, is calculated and used to control the electric motor driving the adjusting shaft.

The camshaft adjuster can thus be operated without directly measuring the angular position of the camshaft to be adjusted. All that is required is the detection of the reference position of the camshaft, wherein the corresponding signal is usually made available to the engine control unit of the internal combustion engine anyway. The aforementioned signal is also referred to as the camshaft trigger edge.

The ring buffers, into which changes in the state of the crankshaft or the adjusting shaft are continuously written, are designed, for example, to record data during a working cycle, i.e. a 360° camshaft rotation, corresponding to a 720° crankshaft rotation. Likewise, it is also possible to record data over several work cycles.

The angular changes of the crankshaft are detected with a finer resolution than the angular changes of the rotor of the electric motor, which is coupled to the adjusting shaft of the actuating gearing in a non-rotatable manner. Due to the given positive or negative reduction ratio of the actuating gearing, which is for example 1:30, 1:60, 1:90 or 1:200 or even more extreme, a very fine resolution of the angular position of the camshaft is nevertheless possible. Preferably, the calculation of the angular position of the camshaft, which takes into account the transmission ratio of the actuating gearing, is carried out with an accuracy that is at least a factor of 5 higher than the detection of the angular position of the crankshaft, in particular with at least 10 times the accuracy.

In a preferred method, the angular positions of both the crankshaft and the rotor of the electric motor, which lie between two positions that can be discretely distinguished from one another with the aid of sensor signals, are determined approximately by calculation through temporal extrapolation. It is assumed that the shaft in question, i.e. the motor shaft of the electric motor or the crankshaft, rotates at a practically constant speed during the period to which the interpolation refers.

The internal combustion engine according to the present disclosure comprises a crankshaft, at least one camshaft which is adjustable electromechanically by means of an actuating gearing, in particular a harmonic drive, an engine control unit, and a camshaft control unit which is provided for controlling an actuating motor, namely an electric motor, which operates the actuating gearing, wherein the engine control unit is linked to a device for detecting the angular position of the crankshaft, and the camshaft control unit is linked to the engine control unit, and wherein a device for detecting a reference position of the camshaft to be adjusted and a device for detecting the angular position of the shaft of the actuating motor are provided as sole means for detecting the angular position of the camshaft, and the camshaft control unit is designed to determine the phase angle of the camshaft in relation to the crankshaft on the basis of the information items provided by said devices in combination with the detected angular position of the crankshaft and the transmission ratio of the actuating gearing.

The electric actuating motor of the camshaft adjuster is designed, for example, as a permanent-magnet synchronous motor. The electric motor has, for example, four or six pairs of poles. Changes in the angular position of the rotor of the electric motor can be detected, for example, with the aid of Hall sensors.

According to one possible embodiment, the engine control unit comprises a ring buffer with two memory areas, which are provided for recording various edges of a crankshaft trigger wheel detected during the rotation of the crankshaft. By detecting rising edges as well as falling edges, not only can a higher resolution be achieved compared to a detection of only similar edges, but also a checking mechanism regarding the freedom of the recorded data from logical contradictions can be implemented. This type of signal processing can also be implemented in the camshaft control unit.

According to a possible embodiment, the camshaft control unit comprises a ring buffer with two memory areas, wherein a first memory area is provided for recording the amount of angular changes of the shaft of the actuating motor, i.e. the rotor of the electric motor, and a second memory area is provided for recording changes in the direction of rotation. A change in the direction of rotation is understood here to mean a change between a leading of the rotor in relation to the camshaft and a reduced speed of the rotor of the electric motor in comparison to the speed of the camshaft. A rotating system is therefore chosen as the reference system to which the change in direction of rotation refers. The rotating system typically includes a chain wheel or belt wheel that is fixed to the housing of the actuating gearing. A change in the direction of rotation of the type described is equivalent to a change in the adjustment direction of the camshaft adjuster.

BRIEF SUMMARY OF THE DRAWINGS

In the following, an exemplary embodiment of the present disclosure is explained in more detail by means of a drawing. The figures show the following in an, in parts, roughly schematized manner.

DETAILED DESCRIPTION

Figure 1:
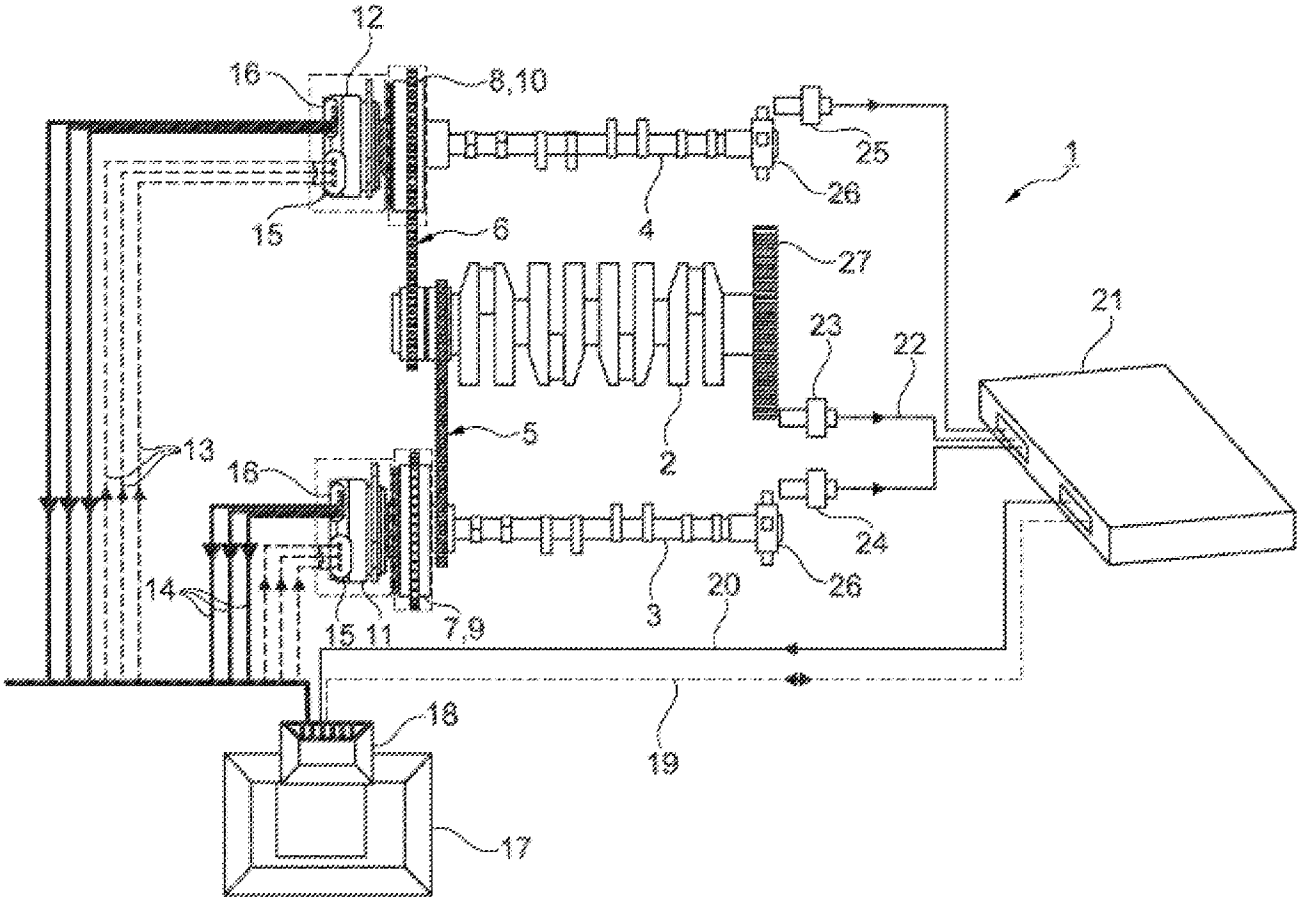
FIG. 1 shows an overview of the components of an internal combustion engine with an electromechanical camshaft adjuster.

An internal combustion engine constructed as an in-line engine and identified overall with the reference sign 1 comprises a crankshaft 2 and two camshafts 3, 4, namely an intake camshaft 3 and an exhaust camshaft 4. Deviating from the exemplary embodiment shown, the internal combustion engine could also be a reciprocating piston engine of a different design, for example a V-engine, which has two intake and two exhaust camshafts.

The camshafts 3, 4 are driven by the crankshaft 2 via chain gears 5, 6. Each camshaft 3, 4 is adjustable by means of an electromechanical camshaft adjuster 7, 8. The camshaft adjusters 7, 8 each have as actuating gearing 9, 10 a three-shaft gearing constructed as a harmonic drive. A shaft on the input side of the actuating gearing 9, 10 is driven by the chain gears 5, 6. The shaft of the actuating gearing 9, 10 on the output side is connected to the camshaft 3, 4 to be adjusted in a non-rotatable manner. A third shaft of each actuating gearing 9, 10 can be driven by an electric motor 11, 12 associated with the respective camshaft adjuster 7, 8. Here, the motor shaft of the electric motor 11, 12, marked 29, on which a rotor 28 is mounted, is coupled to the third shaft of the actuating gearing 9, 10 in a non-rotatable manner, optionally via a compensating coupling. In the exemplary embodiment, the so-called third shaft is an inner ring of a wave generator of the actuating gearing 9, 10 designed as a harmonic drive.

The electric motors 11, 12 are connected to a camshaft control unit 17 via connection lines 13 and signal lines 14. Plug connections of the electric motor 11, 12 for the connection lines 13 are marked with 15, and plug connections for the signal lines 14 with 16. The aforementioned lines 13, 14 are connected to a plug connection 18 of the camshaft control unit 17. Hall signals HSA, HSB, HSC, which are obtained with the aid of Hall sensors, are transmitted via the signal lines 14 and provide information items on changes in the angular position of the rotor 28. The Hall sensors are attributable to a rotor position detection device marked as a whole with 44.

The camshaft control unit 17 is connected to the engine control unit, marked with 21, of the internal combustion engine 1 via a data bus 19, namely a CAN bus, and a signal line 20. A crankshaft sensor 23 is connected to the engine control unit 21 via a line 22. The crankshaft sensor 23 scans a crankshaft trigger wheel 27 which is fixed to the crankshaft 2. Further, sensors 24, 25 are connected to the engine control unit 21, each of which interacts with a trigger disk 26 connected to a camshaft 3, 4.

Figure 2:
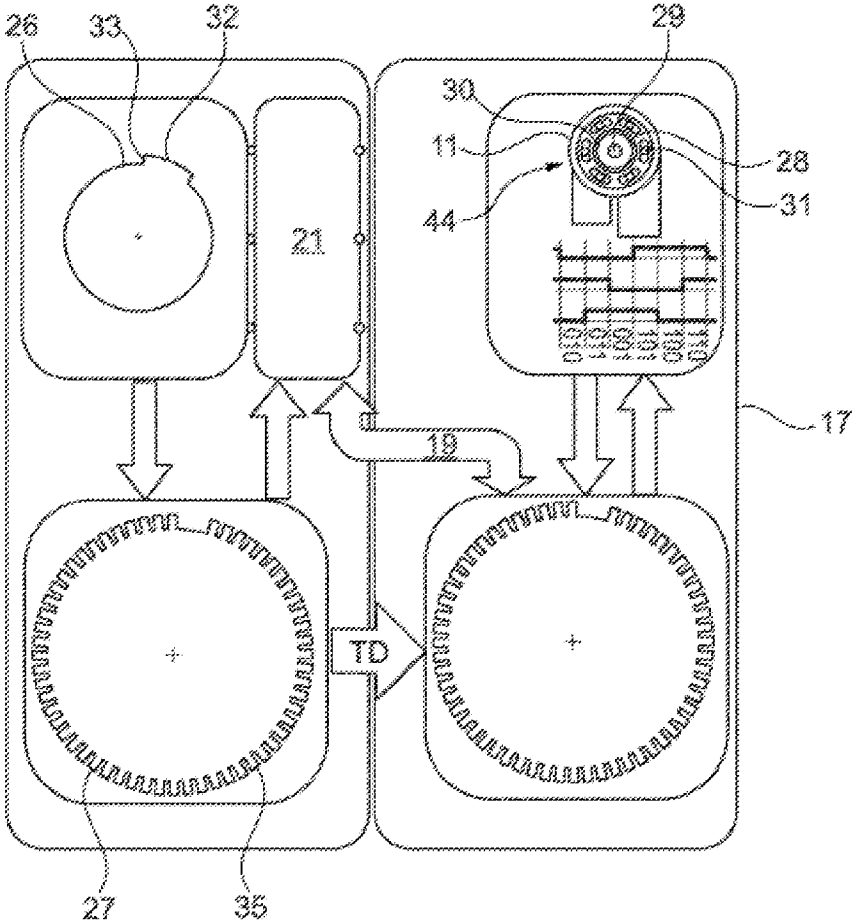
FIG. 2 shows the interaction between an engine control unit and a camshaft control unit of the internal combustion engine.

FIG. 2 illustrates data processing operations in the engine control unit 21 (left) and in the camshaft control unit 17 (right). As can be seen from the illustration, the signal generated by means of the trigger disk 26 is processed within the engine control unit 21. In the exemplary embodiment, the trigger disk 26 has a single protrusion 32. An edge of the protrusion 32 is marked with 33. The edge 33 of the trigger disk 26 provides a camshaft trigger in a known manner. A logical link is established between the camshaft trigger and the scanning of the crankshaft trigger wheel 27.

The crankshaft trigger wheel 27 has teeth 35 which, together with an adjacent gap located between two teeth 35, each cover an angle of 6°. A recess 36 is formed by omitting two teeth, wherein the first tooth 35 adjacent to the recess 36 is a reference mark 34. The signal detected by means of the reference mark 34 is also referred to as the TD signal. A copy of this TD signal, to which a further mark can be added, is sent from the engine control unit 21 to the camshaft control unit 17 via the signal line 20. Within the camshaft control unit 17, the TD signal indicating a reference angular position of the crankshaft is logically linked to features of the electric motor 11, 12.

Figure 3:
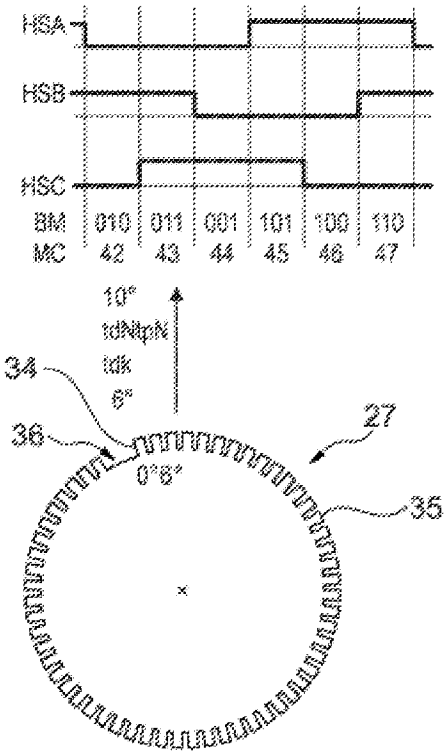
FIGS. 3 and 4 show correlations between measurements on the crankshaft of the internal combustion engine and on components of the camshaft adjuster.
Figure 4:
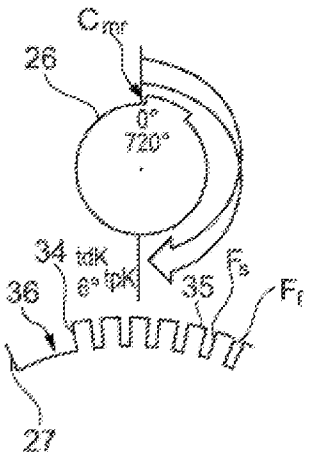

FIG. 2 shows permanent magnets 30 and windings 31 of the electric motor 11, 12. A possible course of Hall signals HSA, HSB, HSC, which provide information items about changes in the angular position of the rotor 28, is recorded in FIG. 3. Each combination of the Hall signals HSA, HSB, HSC corresponds to a bit pattern BM, in the exemplary embodiment the bit patterns 010, 011, 001, 101, 100 and 110. With each change in the bit pattern BM, a pattern counter MC is incremented, in the exemplary embodiment from the value 42 to the value 47. Since each Hall signal HSA, HSB, HSC can assume the value 0 or 1 and six pairs of poles are present, a total of 2.3.6=36 states can be distinguished from one another during one revolution of the motor shaft 29. Each state thus corresponds to an angle of 360°: 36=10°. This angular resolution is thus coarser than the angular resolution realized on the crankshaft 2 with the aid of the crankshaft trigger wheel 27. In fact, much higher angular resolutions can be achieved by extrapolation, as will be explained below with reference to FIG. 4:

A rising edge Fs and a falling edge Ff are given by each tooth 35. The angular distance between two adjacent rising edges Fs is 6°, as already explained. The time difference required for the crankshaft 2 to rotate by 6°, i.e. to continue rotating by one tooth 35, is denoted by tdK. With a good approximation, it can be assumed that the crankshaft speed does not change during further rotation by one tooth 35. Thus, a time interval denoted by tpK, which indicates a partial period of time when the crankshaft 2 continues to rotate from one tooth 35 to the next tooth 35, can be used to calculate any angular position of the crankshaft 2 lying between two teeth 35. In this way, as illustrated in FIG. 4, the camshaft reference position designated Cmr, i.e. the angular position of the camshaft 3, 4 at which the edge 33 is detected, can also be assigned to an exact angular position of the crankshaft 2.

In a comparable manner, the bit patterns BM generated during operation of the electric motor 11, 12 and the pattern counter MC are used to extrapolate angular positions of the camshaft 3, 4. In the case of the camshaft 3, 4, tdN denotes the time period within which one and the same bit pattern BM is present, corresponding to an angle of rotation of the camshaft 3, 4 by 10°. Smaller time intervals tpN, which are measured during the application of one and the same bit pattern BM, are used to calculate the further rotation of the camshaft 3, 4 within the aforementioned angular range of 10°. This calculation also assumes that the motor shaft 29 rotates within the relevant angular range, here the 10° range, at an approximately constant angular velocity.

With regard to the interaction of measurements on the crankshaft 2 and the camshaft adjuster 7, 8, reference is made below to FIG. 5. The detection of the reference mark 34 of the crankshaft trigger wheel 27 indicates a crankshaft reference position Crr. Reaching the crankshaft reference position Crr is recorded in a ring buffer 41 of the engine control unit 21. The ring buffer 41 comprises memory areas 42, 43, for continuously recording the detection of falling edges Ff and rising edges Fs. Events corresponding to at least one crankshaft revolution can be written into the ring buffer 41.

Compared to the crankshaft trigger wheel 27, the trigger disk 26 supplies the camshaft 3, 4 with data with a much lower frequency. The detection of the edge 33 on the trigger disk 26 is related in time to the angular position of the crankshaft 2, as illustrated in FIG. 5, wherein this relationship can be established in a simple manner by counting the teeth 35 which have been detected by the crankshaft sensor 23 from the crankshaft reference position Crr. The engine control unit 21 provides the relation between the crankshaft reference position Crr and the camshaft reference position Cmr and transmits it asynchronously to the camshaft control unit 17 via the data bus 19.

Figure 5:
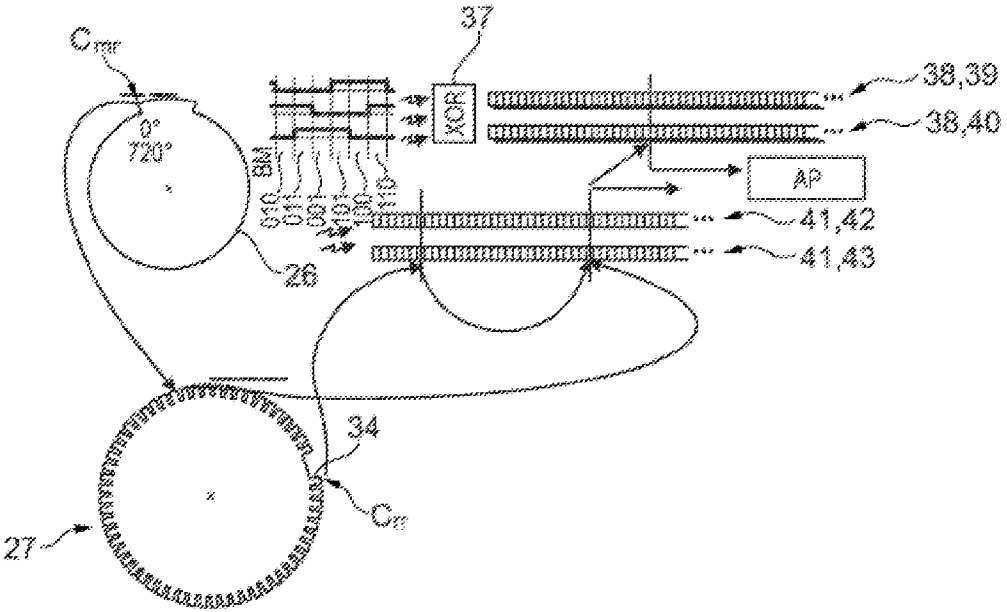
FIG. 5 shows data connections between different components of the internal combustion engine.

The camshaft control unit 17 comprises an evaluation unit 37, marked with XOR in FIG. 5, which evaluates the Hall signals HSA, HSB, HSC, wherein the direction of rotation of the rotor 28 is also detected. The detected data is written into a ring buffer 38 of the camshaft control unit 17. The ring buffer 38 comprises a memory area 39 for information items indicating the amount of angular changes of the rotor 28, also commonly referred to as speed signals, and a memory area 40 for direction signals, that is, signals indicating the direction of rotation of the rotor 28.

The data stored in the various memory areas 39, 40 are used, based on the known relation between the reference positions Crr, Cmr, as well as on the transmission ratio of the actuating gearing 9, 10, which is also known, to calculate the phase value designated AP, i.e. the phase relation between camshaft 3, 4 and crankshaft 2. The complete, precise calculation of the phase value AP is thus performed without any measurement on the camshaft 3, 4, apart from the detection of the camshaft reference position Cmr by detecting the edge 33 of the trigger disk 26. Deviating from the exemplary embodiment, the trigger disk 26 can also be located elsewhere on the internal combustion engine 1, wherein a trigger signal is generated, for example, once per camshaft revolution or once per crankshaft revolution.

LIST OF REFERENCE SIGNS

1 Internal combustion engine
2 Crankshaft
3 Camshaft
4 Camshaft
5 Chain gears
6 Chain gears
7 Camshaft adjuster
8 Camshaft adjuster
9 Actuating gearing
10 Actuating gearing
11 Electric motor
12 Electric motor
13 Connection line
14 Signal line
15 Plug connection for connection lines
16 Plug connection for signal lines
17 Camshaft control unit
18 Plug connection of the camshaft control unit
19 Data bus
20 Signal line
21 Engine control unit
22 Line

23 Crankshaft sensor
24 Sensor
25 Sensor
26 Trigger disk
27 Crankshaft trigger wheel
28 Rotor
29 Motor shaft
30 Permanent magnet
31 Winding
32 Protrusion
33 Edge
34 Reference mark
35 Tooth
36 Recess
37 Evaluation unit
38 Ring buffer of the camshaft control unit
39 Memory area
40 Memory area
41 Ring buffer of the engine control unit
42 Memory area
43 Memory area
44 Rotor position detection device
AP Phase value
BM Bit pattern
Crr Crankshaft reference position
Cmr Camshaft reference position
Ff Falling edge
Fs Rising edge
HSA Hall signal
HSB Hall signal
HSC Hall signal
MC Pattern counter
TD TD signal
tdK Time difference from certain position of the crankshaft
tdN Time difference from certain position of the camshaft
tpK Time interval, related to two specific crankshaft positions
tpN Time interval, related to two specific camshaft positions

What is claimed is:

1. A method for operating an electromechanical camshaft adjuster, including an actuating gearing, of an internal combustion engine including a crankshaft and a camshaft, the method comprising:

continuously detecting an angular position of the crankshaft, wherein an incremental detection of angular changes takes place starting from a detected angular reference position;

recurrently recording the detected angular positions of the crankshaft in a first ring buffer;

detecting a reference position of the camshaft;

assigning a point in time at which the reference position of the camshaft was detected to a corresponding angular position of the crankshaft recorded in the first ring buffer;

detecting changes in an angular position of a rotor of an electric motor configured to drive an adjusting shaft of the actuating gearing;

recording the changes in the angular position of the rotor corresponding to said point in time in a second ring buffer;

calculating a current angular position of the camshaft from based on (i) the recorded changes in the angular position of the rotor, and (ii) a transmission ratio of the actuating gearing;

assigning the current angular position of the camshaft to a current angular position of the crankshaft;

calculating a phase difference between the current angular position of the crankshaft and the current angular position of the camshaft; and controlling the electric motor based on the phase difference, wherein an accuracy of the calculating of the current angular position of the camshaft is at least 5 times greater than an accuracy of the detecting of the angular position of the crankshaft.

2. The method according to claim 1, wherein the phase difference is calculated exclusively based on the detected angular positions of the crankshaft and detected angular positions of the adjusting shaft.

3. The method according to claim 1, wherein an angular position of the adjusting shaft is detected over a crankshaft angle of 720°.

4. The method according to claim 1, wherein the detecting of the angular position of the crankshaft is performed with a finer resolution than the detecting of the changes in the angular position of the rotor.

5. The method according to claim 4, wherein when an angular position of either of the crankshaft and the rotor lies between two discrete positions distinguishable from one another via corresponding sensor signals, the angular position is approximated via temporal extrapolation.

6. An internal combustion engine, comprising:

a crankshaft;

a camshaft;

an actuating gearing configured to electromechanically adjust the camshaft;

an actuating motor configured to operate the actuating gearing via a motor shaft;

a first device configured to detect an angular position of the crankshaft;

a second device configured to detect a reference position of the camshaft;

a third device configured to detect an angular position of the motor shaft;

a camshaft control unit configured to:

control the actuating motor, determine an angular position of the camshaft solely based on signals received from the second device and the third device, and calculate a phase angle of the camshaft with respect to the crankshasft based on (i) signals received from the first device, the second device, and the third device, and (ii) a transmission ratio of the actuating gearing; and an engine control unit linked to the first device and to the camshaft control unit, the engine control unit configured to control the engine based on the phase angle of the camshaft, wherein an accuracy at which the phase angle of the camshaft is calculated is at least 5 times greater than an accuracy at which the angular position of the crankshaft is detected.

7. The internal combustion engine according to claim 6, wherein the actuating motor is a permanent-magnet synchronous motor.

8. The internal combustion engine according to claim 6, wherein:

the crankshaft comprises a trigger wheel including a plurality of teeth, the first device is further configured to detect a rising edge and a falling edge of each tooth, and the engine control unit comprises a first ring buffer including two memory areas configured to respectively record the detected rising and falling edges during rotation of the crankshaft.

9. The internal combustion engine according to claim 6, wherein the camshaft control unit comprises a second ring buffer including a first memory area configured to record changes in the angular position of the motor shaft, and a second memory area configured to record changes in a rotation direction of the motor shaft.

10. An internal combustion engine comprising:

a crankshaft;

a camshaft;

an actuating gearing configured to electromechanically adjust the camshaft;

an electric motor configured to operate the actuating gearing, the electric motor including a rotor;

a camshaft control unit;

a first sensor configured to detect an angular position of the crankshaft;

a second sensor configured to detect a reference position of the camshaft; and a third sensor configured to detect an angular position of the rotor; and an engine control unit configured to:

receive the detected angular position of the crankshaft from the first sensor, receive the detected reference position of the camshaft from the second sensor, determine a timing relationship between a reference position of the crankshaft and the reference position of the camshaft, and asynchronously transmit the timing relationship to the camshaft control unit;

wherein the camshaft control unit is configured to:

receive the detected angular position of the rotor from the third sensor, determine a phase value of the camshaft with respect to the crankshaft based on the timing relationship, the detected angular position of the crankshaft, the detected angular position of the rotor, and a transmission ratio of the actuating gearing, and control the electric motor based on the phase value of the camshaft, and wherein an accuracy at which the phase value of the camshaft is determined is at least 5 times greater than an accuracy at which the angular position of the crankshaft is detected.

11. The internal combustion engine recited in claim 10 wherein the first sensor includes:

a crankshaft trigger wheel fixed to the crankshaft, and a crankshaft sensor connected to the engine control unit, the crankshaft sensor configured to scan the crankshaft trigger wheel.

12. The internal combustion engine recited in claim 11 wherein the second sensor includes:

a camshaft trigger disk fixed to the camshaft, and a camshaft sensor connected to the engine control unit, the camshaft sensor configured to scan the camshaft trigger disk.

13. The internal combustion engine recited in claim 12 wherein the camshaft trigger disk is configured to provide data at a different frequency than the crankshaft trigger wheel.

14. The internal combustion engine recited in claim 13 wherein the camshaft trigger disk is configured to provide data less frequently than the crankshaft trigger wheel.

15. The internal combustion engine recited in claim 14 wherein:

the crankshaft trigger wheel includes a plurality of teeth configured to be scanned via the crankshaft sensor, and the camshaft trigger disk includes a protrusion configured to be scanned via the camshaft sensor.

* * * * *